US006794968B2

(12) United States Patent
Arnholt

(10) Patent No.: US 6,794,968 B2
(45) Date of Patent: Sep. 21, 2004

(54) MAGNETIC LATCHING CONTACTOR

(75) Inventor: James Arnholt, Mansfield, OH (US)

(73) Assignee: Contact Industries, Inc., Mansfield, OH (US)

( * ) Notice: Subject to any disclaimer, the term of this patent is extended or adjusted under 35 U.S.C. 154(b) by 0 days.

(21) Appl. No.: 10/214,233

(22) Filed: Aug. 7, 2002

(65) Prior Publication Data

US 2003/0210117 A1 Nov. 13, 2003

Related U.S. Application Data

(60) Provisional application No. 60/379,700, filed on May 9, 2002.

(51) Int. Cl.[7] ..... H01H 9/00

(52) U.S. Cl. ..... 335/179; 335/229

(58) Field of Search ..... 335/167–176, 335/177–179, 180–185, 254–257, 266, 268, 220–229

(56) References Cited

U.S. PATENT DOCUMENTS 2,919,324 A * 12/1959 Schuessler ..... 335/137
3,022,450 A * 2/1962 Chase, Jr. ..... 361/194
4,534,539 A * 8/1985 Dettmann ..... 251/65
4,641,117 A * 2/1987 Willard ..... 335/7
4,876,521 A * 10/1989 Boyd ..... 335/179
5,006,826 A * 4/1991 Knoben et al. ..... 335/35
6,218,921 B1 * 4/2001 Eberts et al. ..... 335/176
6,236,293 B1 5/2001 Forster

* cited by examiner

*Primary Examiner*—Lincoln Donovan
(74) *Attorney, Agent, or Firm*—Kevin G. Mierzwa

(57) ABSTRACT

A contactor assembly includes a stationary assembly, a movable assembly that is slidably coupled with the stationary assembly, and a contact assembly coupled within the stationary assembly and the movable assembly. The contact assembly is movable between a first switching position where an electrically closed circuit is established and a second position where an electrically open position is established. The stationary assembly has a solenoid housing that is used to move the movable assembly between the first position and the second position. The solenoid housing may include a first coil and a second coil therein. Further, a pair of magnets is positioned between the solenoid coils and the housing to provide magnetic flux to maintain the contactor in an electrically closed position.

15 Claims, 3 Drawing Sheets

MAGNETIC LATCHING CONTACTOR

RELATED APPLICATION

The present invention is related to U.S. provisional application No. 60/379,700 entitled "Comparison Of Conventional Contactor To Magnetically Latching Contactor" filed on May 9, 2002, and incorporated by reference herein

TECHNICAL FIELD

The present invention relates generally to electrical contactors. More specifically, the present invention relates to magnetic latching contactors.

BACKGROUND

Electrical contactors and relays are commonly used for switching relatively large amounts of electrical current using relatively low current switching signals. An electrical contactor typically has electrical switching contacts for closing and opening an electrical circuit connected to the contactor. An electromechanical device is typically utilized to move the electrical switching contacts into and out of physical contact, thereby closing and opening the electrical circuit, respectively. The operation of the electromechanical device, in turn, is typically controlled by a relatively low current switching signal.

Many contactors have one passive stable switching position and one unstable active switching position. The stable switching position is passively maintained in the absence of externally provided active energy. For instance, a simple spring is often used to bias the electrical contacts into a first switching position, which will then be passively maintained. When a change in switching position is desired, an electrical switching signal is provided to the contactor, which in turn induces an active switching force on the electrical contacts. The active switching force moves the contacts into a second switching position, which is maintained until the electrical switching signal is removed from the contactor. A significant drawback to contactors with only one stable switching position is that energy must continually be supplied to the contactor to maintain the unstable switching position. This inefficient use of energy results in higher operational costs and also introduces heating problems into the contactor use and design.

To address these problems and others, contactors have been designed which provide multiple stable switching positions. Various arrangements and types of switching elements, electrical coils, springs, permanent magnets and mechanical latching mechanisms have been proposed to provide contactors with multiple stable switching positions.

While contactors with multiple stable switching positions have performed satisfactorily, those working in this art have recognized that important design improvements are needed. These include contactor reliability, particularly in high current switching applications where safety is of primary concern. One drawback of present contactors using mechanical latching mechanisms is that the latching mechanisms tend to wear out over time. To avoid the unreliability of mechanical latching mechanisms, some contactor designs utilize permanent magnets for latching. However, the permanent magnets are often placed in positions exposing them to mechanical stress and shock. The permanent magnets themselves then become potential failure points. Manufacturability is another important concern since it is closely related to product cost and quality. Typical contactor designs providing two stable switching positions involve a high number of piece-parts in manufacturably undesirable configurations. Such a configuration is illustrated in U.S. Pat. No. 6,236,293. Also contactors have been designed to operate over a particular electrical current range, and these designs are not necessarily readily extendible to a contactor designed to operate over a different current range.

Hence, a longstanding need has existed for an improved electrical contactor that has multiple stable switching positions and that is cost effective, reliable, manufacturable and extendible to a variety of electrical current ranges.

SUMMARY OF THE INVENTION

The present invention provides an improved contactor that uses permanent magnets to position the contactor in one of the positions.

In one aspect of the invention, a contactor assembly comprises a stationary assembly, a movable assembly slidably coupled with the stationary assembly, and a contact assembly that is coupled with the stationary assembly and with the movable assembly and movable between a first position, where an electrically closed circuit is established and a second position, where an electrically open circuit is established. The stationary assembly has a solenoid housing having a top surface adjacent to the contactor assembly and a bottom surface spaced apart from the top surface. The stationary assembly has a coil position within the housing. The coil moves said movable assembly when electricity is applied to the coil.

In a further aspect of the invention, a contactor assembly comprises a stationary assembly, a movable assembly slidably coupled with the stationary assembly, and a contact assembly that is coupled with the stationary assembly and with the movable assembly and movable between a first position, where an electrically closed circuit is established and a second position, where an electrically open circuit is established. The stationary assembly has a solenoid housing having a first coil and a second coil positioned therein. The first coil and the second coil move the movable assembly when electricity is applied to at least one of the first coil and the second coil.

One advantage of the invention is that the amount of flux coupled to the core is more controlled, thus a more reliable system is provided.

Other advantages and features of the present invention will become apparent when viewed in light of the detailed description of the preferred embodiment when taken in conjunction with the attached drawings and appended claims.

DESCRIPTION OF THE PREFERRED EMBODIMENT

Figure 1:
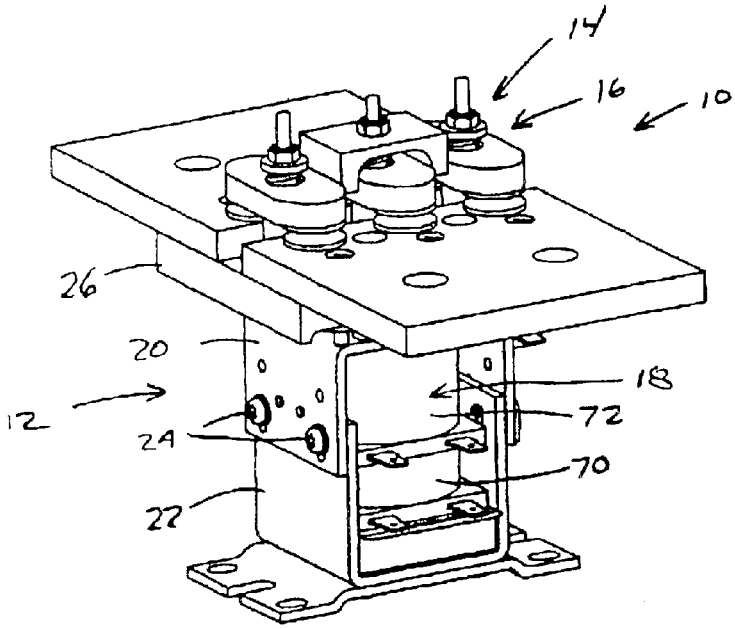
FIG. 1 is a perspective view of a contactor according to the present invention.

In the following figures the same reference numerals will be used to identify the same components in the various views. Although one specific configuration is illustrated, those skilled in the art will recognize various alternatives in view of the teachings the present invention. Spatially oriented terms such as top and bottom are meant to provide convenience in terms of the figures illustrated. These terms do not necessarily describe the absolute location and space in which a part may be oriented.

Figure 2:
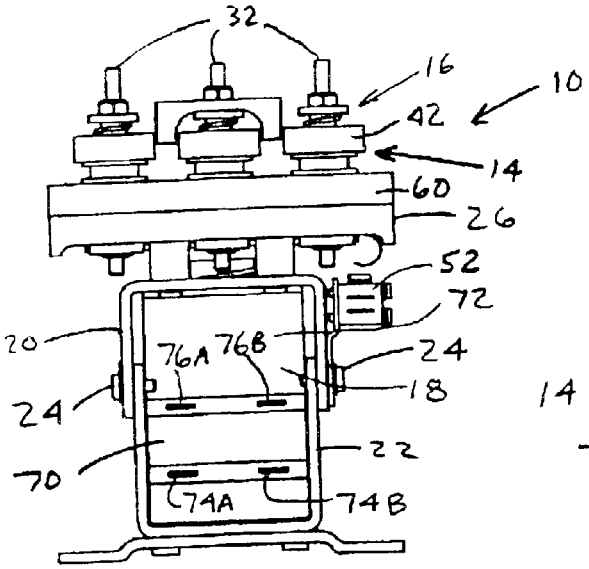
FIG. 2 is a side view of the contactor in the open position.
Figure 3:
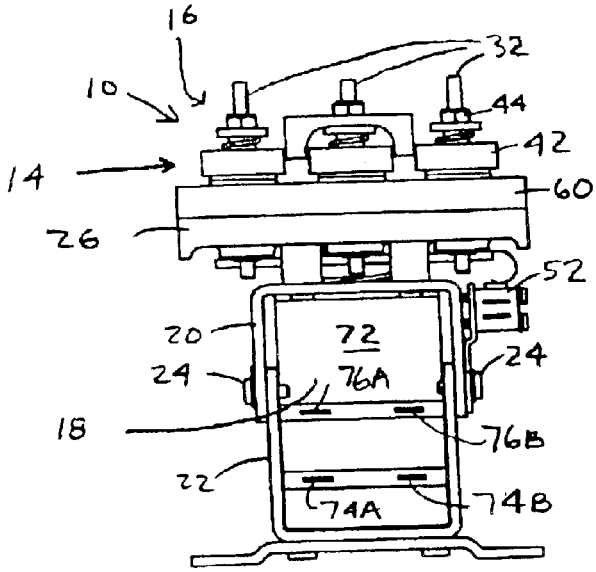
FIG. 3 is a side view of the contactor in the closed position.
Figure 4:
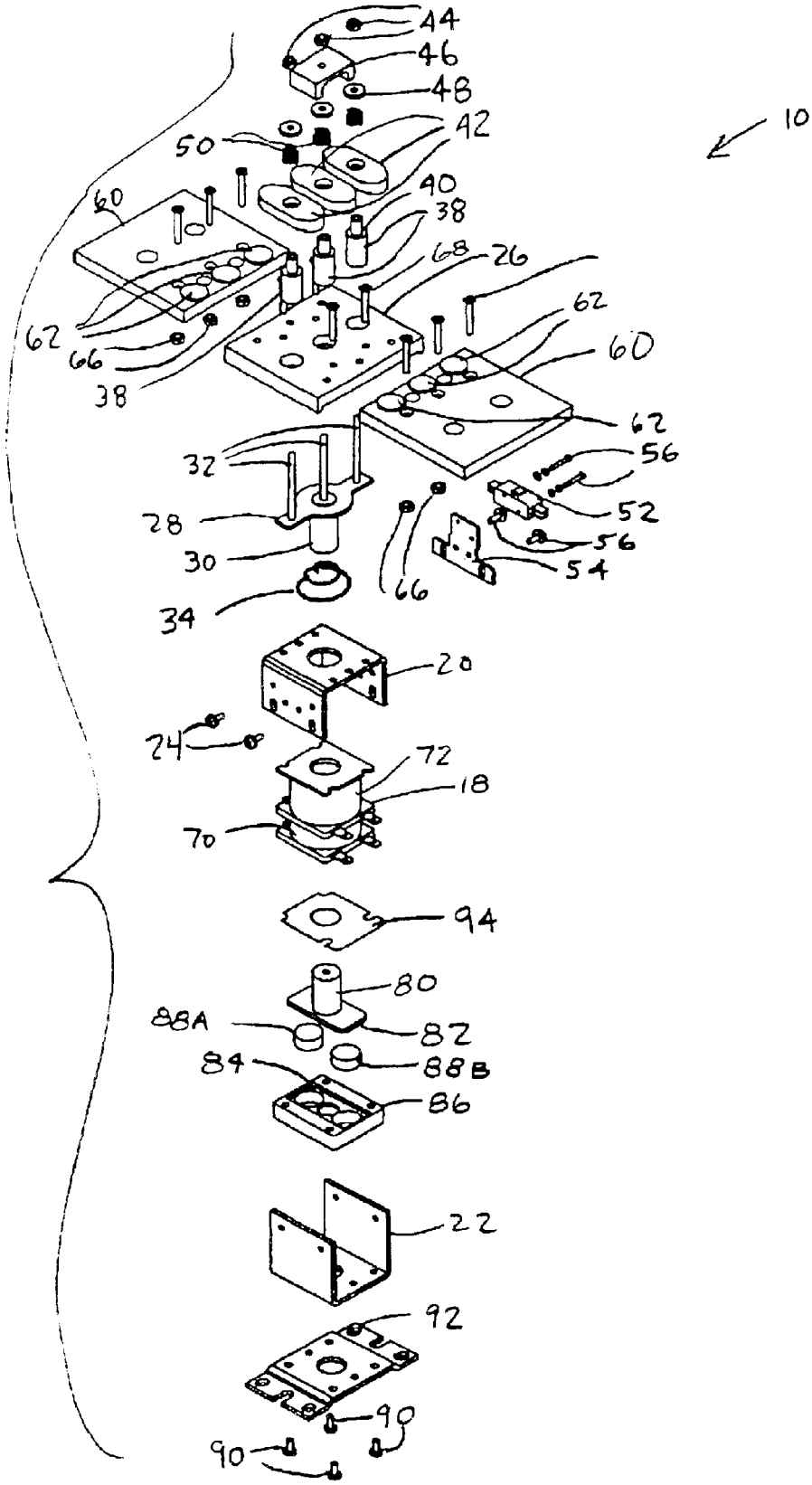
FIG. 4 is an exploded perspective view of the present invention.

Referring now to FIGS. 1, 2, 3, and 4, a contactor assembly 10 is illustrated having a stationary assembly 12, a movable assembly 14, and a contact assembly 16. Contactor assembly 10 may also have a coil assembly 18 that is fixably positioned within stationary assembly 12. Stationary assembly 12 includes a first housing portion 20 and a second housing portion 22. As illustrated, the first housing portion 20 and the second housing portion 22 are generally U-shaped and are coupled together to define a space therein. The first housing portion 20 is positioned adjacent to the contact assembly 16 and may be referred to as a top portion. The second housing portion 22 is coupled therebelow. The first housing portion 20 and the second housing portion 22 are fastened together with fasteners 24 that may include screws, rivets or other types of fastening devices.

An insulating member 26 is positioned between the stationary assembly 12 and the contact assembly 16. Insulating member 26 insulates the contact assembly 16 from the stationary member 12 such as the first housing portion 20.

Movable assembly 14 has an operator plate 28 that is coupled to movable core 30. Operator plate 28 has a plurality of shafts 32 extending upward therefrom. The movable assembly is biased in an upward position by a spring 34. Spring 34 provides a force between first housing portion 20 and operator plate 28.

Shafts 32 are sized to receive insulators 38 thereon. Insulators 38 are preferably cylindrically shaped with two diameters that form a shoulder 40 thereon. Shoulders 40 receive contact bridges 42 thereon. Contact bridges 42 are secured to shafts 32 by nuts 44 that may be threadably coupled to shafts 32. A retainer 46, washers 48, and springs 50 may also be coupled on shafts 32.

A control circuit 52 and a control circuit plate 54 may be attached to first housing portion 20 using fasteners 56.

Contact assembly 16 includes a pair of contact plates 60. Each contact plate 60 has a plurality of contacts 62 disposed thereon. Contacts 62 are electrically coupled together through bridge 42 when the movable assembly is in the lower or contacted position. Contactor plates 60 are coupled to insulator 62 using fasteners 64 and nuts 66. Insulator 26 is coupled to first housing portion 20 also using fasteners 68. Fasteners 68 may be various types of fasteners including but not limited to nuts and bolts or heat staking.

Coil assembly 18 in the preferred embodiment of the invention has a first coil 70 and a second coil 72 positioned coaxially to and adjacent to each other. The first coil 70 is used to move the movable assembly 14 in a first direction while the second coil is used to move the movable assembly 14 in a second direction. Those skilled in the art will recognize that one coil may be provided, however, more complex control circuitry is required.

Figure 5:
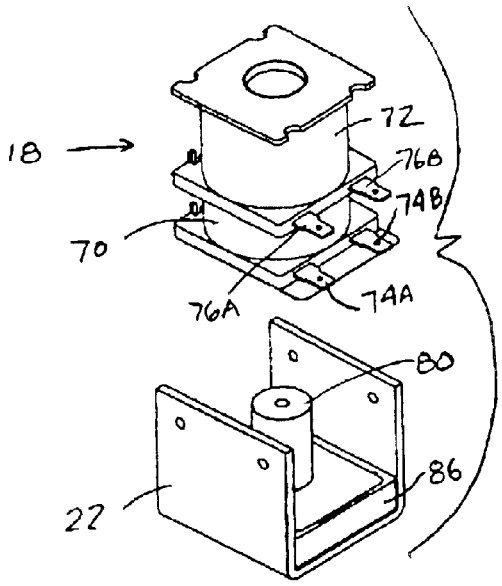
FIG. 5 is a partially exploded perspective view of a portion of the stationary assembly of the present invention.
Figure 6:
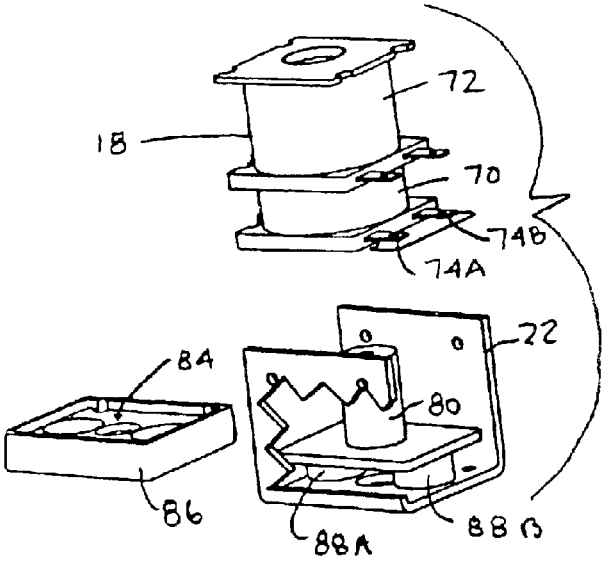
FIG. 6 is a partially exploded and cut away view of the stationary assembly of FIG. 5.
Figure 7:
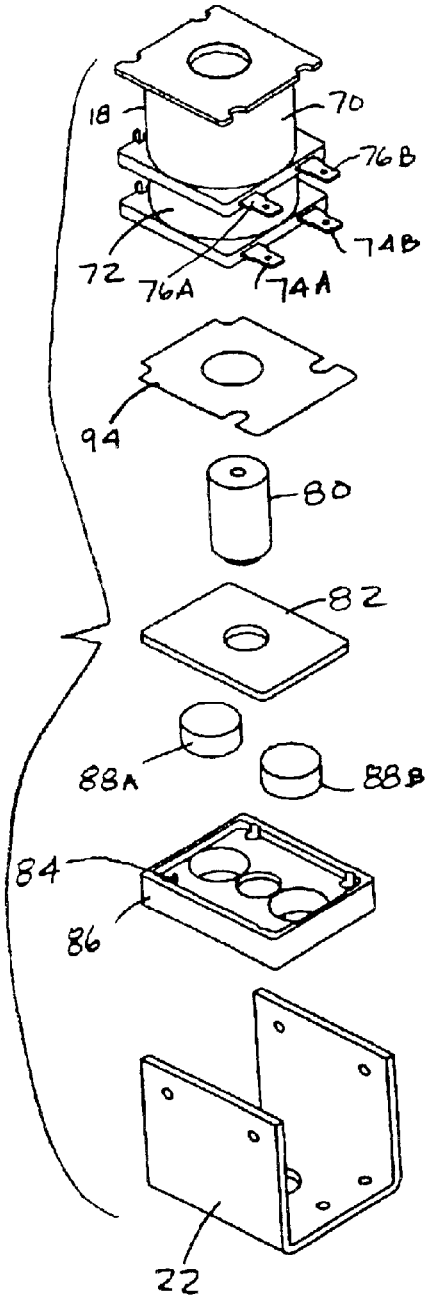
FIG. 7 is an exploded view of a portion of the stationary assembly shown in FIGS. 5 and 6.

Referring now to FIGS. 4, 5, 6, and 7, stationary assembly 12 and coil assembly 18 are illustrated in further detail. First coil 70 has a first pair of contact terminals 74A and 74B. Second coil 72 has contact terminals 76A and 76B.

Housing 22 has a stationary core 80 positioned therein. Stationary core 80 is positioned adjacent to a flux distribution plate 82. Flux distribution plate 82 is sized to be received within a channel 84 of a magnet retaining case 86. Magnet retaining case 86 is used to receive two magnets 88A and 88B. The magnet retaining case 86 may be secured to housing 22 using fasteners 90. A bracket 92 may also be secured to second housing portion 22 with fasteners 90. A spacer 94 may also be positioned between flux distribution plate 82 and coil assembly 18.

Magnets 88A and 88B are positioned on either side of the longitudinal axis of the stationary core 80 and movable core 30 so that flux from the magnets 88A and 88B extend through core 82. The flux from magnets 88A and 88B are strong enough to overcome the force of spring 34 on movable assembly 14 to maintain the contacts in a closed position. Thus, the movable core 30 extends through first housing portion 20 and into coil assembly 18 adjacent to stationary core 80.

In operation, the control switch 52 is used to control the operation of coil assembly 18. Preferably, each coil is independently and sequentially operated to provide the desired latching characteristics. Coil 70 is used to move the contactor assembly into a closed position while coil 72 is used to release the movable assembly and open the contacts. In an initial position where the movable assembly is biased outward by spring 34, to move movable assembly 28 and thus movable core 30 toward stationary core 80, coil 70 is energized to produce magnetic flux to add to the magnetic flux from magnets 88A and 88B. When the movable core 30 is close enough to stationary core 80, contacts 62 will electrically contact bridges 42 and thus provide power between contact plates 60. The magnets maintain the position of the contacts after current is removed from coil 70. Coil 70 may then be de-energized.

When the contacts 62 and contact bridge 42 is desired to be open, coil 72 is energized by passing current therethrough which, in turn, moves movable assembly 14 and movable core 30 away from stationary core 80. Spring 21 maintains the movable assembly 14 in the open position so that contacts 62 electrically contact bridges 42.

While particular embodiments of the invention have been shown and described, numerous variations and alternate embodiments will occur to those skilled in the art. Accordingly, it is intended that the invention be limited only in terms of the appended claims.

What is claimed is:

1. A contactor assembly comprising:

a stationary assembly a moveable assembly slidably coupled with the stationary assembly; and a contact assembly coupled within the stationary assembly and with the moveable assembly and movable between a first switching position, where an electrically closed circuit is established and a second position, where an electrical open circuit is established;

said stationary assembly having a solenoid housing having first coil and a second coil positioned therein, said first coil and said second coil moving said movable assembly in opposite directions when electricity is supplied to the respective first coil and second coil, said stationary assembly comprising a flux distribution plate positioned axially between said first coil and said solenoid housing, and a first magnet and a second magnet positioned axially between the flux distribution plate and said solenoid housing; wherein said first coil and said second coil have a longitudinal axis; said first magnet and said second magnet not being aligned with said longitudinal axis.

2. A contactor assembly as recited in claim 1 wherein said first magnet and said second magnet are equidistant from said longitudinal axis.

3. A contactor assembly as recited in claim 1 wherein the first coil comprises an opening coil.

4. A contactor assembly as recited in claim 1 wherein said second coil comprises a closing coil.

5. A contactor assembly as recited in claim 1 wherein said first magnet and said second magnet are positioned in a magnet retaining case.

6. A contactor assembly as recited in claim 5 wherein the magnet retaining case comprises a channel therein sized to receive the flux distribution plate.

7. A contactor assembly as recited in claim 5 wherein the magnet retaining case comprises a first hole and a second hole sized to receive said first magnet and said second magnet.

8. A contactor assembly as recited in claim 1 further comprising a spacer positioned between said flux distribution plate and said first coil.

9. A contactor assembly comprising:

a stationary assembly;

a moveable assembly slidably coupled with the stationary assembly;

a contact assembly coupled within the stationary assembly and with the moveable assembly and movable between a first switching position, whore an electrically closed circuit is established and a second position, where an electrical open circuit is established;

said stationary assembly having a solenoid housing having a top surface adjacent to said contact assembly and a bottom surface spaced apart from the top surface, said stationary assembly having a having coil positioned within the solenoid housing, said coil moving said movable assembly when electricity is supplied to said coil, said stationary assembly further having a flux distribution plate disposed axially between the bottom surface and said coil and a pair of magnets disposed axially between said flux distribution plate and said bottom surface wherein said coil has a longitudinal axis, said pair of a magnets not being aligned with said longitudinal axis.

10. A contactor assembly as recited in claim 9 wherein said coil comprises a first coil and a second coil.

11. A contactor assembly as recited in claim 9 wherein said pair of magnets are positioned in a magnet retaining case.

12. A contactor assembly as recited in claim 11 wherein the magnet retaining case comprises a channel therein sized to receive the flux distribution plate.

13. A contactor assembly as recited in claim 11 wherein the magnet retaining case comprises a first hole and a second hole sized to receive a first magnet and a second magnet of the pair of magnets.

14. A contactor assembly as recited in claim 9 further comprising a spacer positioned between said flux distribution plate and said first coil.

15. A contactor assembly as recited in claim 9 wherein said pair of magnets are equidistant from said longitudinal axis.

* * * * *

UNITED STATES PATENT AND TRADEMARK OFFICE

CERTIFICATE OF CORRECTION

PATENT NO. : 6,794,968 B2 
DATED : September 21, 2004
INVENTOR(S) : James Arnholt and Rodney E. Daiber It is certified that error appears in the above-identified patent and that said Letters Patent is hereby corrected as shown below:

Title page,
Item [75], Inventor, should read -- James Arnholt, Mansfield, OH (US), Rodney E. Daiber, Mansfield, OH (US) --

Signed and Sealed this

Eleventh Day of January, 2005

JON W. DUDAS
*Director of the United States Patent and Trademark Office*